US007805823B2

(12) United States Patent
Sembritzky et al.

(10) Patent No.: US 7,805,823 B2
(45) Date of Patent: Oct. 5, 2010

(54) AXIAL SWAGE ALIGNMENT TOOL

(75) Inventors: David D. Sembritzky, Grapevine, TX (US); Terry L. Saville, St. Charles, MO (US)

(73) Assignee: Bell Helicopter Textron Inc., Fort Worth, TX (US)

( * ) Notice: Subject to any disclaimer, the term of this patent is extended or adjusted under 35 U.S.C. 154(b) by 1216 days.

(21) Appl. No.: 10/575,195

(22) PCT Filed: Mar. 31, 2004

(86) PCT No.: PCT/US2004/009828

§ 371 (c)(1),
(2), (4) Date: Apr. 7, 2006

(87) PCT Pub. No.: WO2005/105367

PCT Pub. Date: Nov. 10, 2005

(65) Prior Publication Data

US 2007/0163101 A1 Jul. 19, 2007

(51) Int. Cl.
*B21D 39/00* (2006.01)

(52) U.S. Cl. ..... 29/516; 29/234; 29/237; 29/252; 29/282; 29/283.5

(58) Field of Classification Search ..... 29/282, 29/283.5, 516, 234, 237, 252
See application file for complete search history.

(56) References Cited

U.S. PATENT DOCUMENTS

| | | | | |
|---|---|---|---|---|
| 2,514,374 | A | 9/1944 | Cooper | |
| 2,656,607 | A | 1/1952 | Harding | |
| 3,540,246 | A * | 11/1970 | Jones, Jr. | 72/2 |
| 3,938,234 | A * | 2/1976 | Price | 29/237 |
| 4,553,335 | A * | 11/1985 | Woyton | 33/645 |
| 5,398,394 | A * | 3/1995 | Hyatt et al. | 29/237 |
| 6,059,171 | A * | 5/2000 | Yamanaka et al. | 228/164 |
| 6,430,792 | B1 | 8/2002 | Foster et al. | |

FOREIGN PATENT DOCUMENTS

NL 8204763 7/1984

OTHER PUBLICATIONS

Supplementary European Search Report dated Jan. 18, 2010 from EP 04821942.

* cited by examiner

*Primary Examiner*—David P Bryant
*Assistant Examiner*—Bayan Salone
(74) *Attorney, Agent, or Firm*—James E. Walton

(57) ABSTRACT

An axial swage alignment tool (11) having a bridge member (27) for axially and rotationally aligning a metal tube (21) and a fitting (31) is disclosed. The bridge member that is temporarily bonded to the exterior surfaces of the metal tube and the fitting. The bridge member eliminates the need to place any material between the metal tube and the fitting either prior to or after the swaging process.

10 Claims, 2 Drawing Sheets

AXIAL SWAGE ALIGNMENT TOOL

TECHNICAL FIELD

The present invention relates to alignment tools. In particular, the present invention relates to axial swage alignment tools.

DESCRIPTION OF THE PRIOR ART

Many complicated machines require metal tubing for carrying pressurized fluids, such as fuel and hydraulic fluid. Often, this metal tubing is formed by assembling together several small metal tubes. This is particularly true for metal tubing that has curves, bends, joints, and other complicated shapes. When assembling the small metal tubes, the joints must be coupled together with fluid tight seals that can withstand the pressures required by the machine. Some applications, such as aircraft applications, require specialized couplings, or fittings, that must be swaged onto the metal tubes with high-precision swaging tools to provide proper, fluid-tight, metal-to-metal seals and ensure that the resultant metal tubing conforms to strict dimensional tolerances. These swaging tools are typically high-pressure hydraulic machines that are capable of slightly deforming the metal tubing and the specialized fittings. Once the tubes and fitting are swaged together, they cannot be separated without damaging the tubes and fittings.

Often, due to space constraints, the swaging tool will not fit into the required location to swage the metal tubes and fittings. When this happens, the metal tubes and fittings must be removed from the machine, swaged remote from the machine, and then reinstalled onto the machine as assembled metal tubing. These parts must be temporarily fastened together so that the orientation between them is maintained while they are remotely swaged together. Both the rotational alignment and the axial alignment must be accurately maintained. If the proper orientation is not maintained, the resultant metal tubing will not fit properly when it is reinstalled onto the machine.

Several problems arise when metal tubes and fittings must be removed from the machine and remotely swaged together. With one method, the tubes and fittings must be precisely marked with reference marks to ensure the proper axial and rotational orientation. This is a time consuming process that is prone to errors. Often, the marks are made by hand with dull markers. With another method, the metal tubes and fittings must be temporarily fastened together. This is typically done by driving small wedges between the metal tube and the fitting, or by using super glue between the metal tube and the fitting. Methods that require the placement of materials between the metal tube and the fitting are undesirable. Wedges do not work well, because they fall out when the assembly is moved. Adhesives do not work well, because they degrade the seal.

Although there have been significant developments in the area of swaging metal tubing, considerable shortcomings remain.

SUMMARY OF THE INVENTION

There is a need for an axial swage alignment tool that can accurately maintain the proper orientation between the swaged parts.

Therefore, it is an object of the present invention to provide an axial swage alignment tool that can accurately maintain the proper orientation between the swaged parts.

This object is achieved by providing an axial swage alignment tool having a bridge member that is temporarily bonded to the exterior surfaces of the metal tubing and the fitting. The tool does not require placing any material between the metal tube and the fitting.

The present invention provides significant advantages, including: (1) the metal tubes and the fittings can be removed from the machine and accurately swaged remote from the tool; (2) specialized marking templates are not required; (3) the parts do not have to marked prior to removal; (4) the axial alignment of the fitting on the metal tube is adjustable, i.e., the metal tube does not have to be axially bottomed-out into the fitting; and (5) because the bridge member is only bonded to the exterior surfaces of the metal tube and the fitting, it is not necessary to place any material between the metal tube and the fitting.

Additional objectives, features, and advantages will be apparent in the written description that follows.

BRIEF DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, wherein:

DESCRIPTION OF THE PREFERRED EMBODIMENT

The present invention represents the discovery that metal tubes and fittings can be swaged together without placing adhesives and other materials between the metal tubes and the fittings. The alignment tool according to the present invention is particularly useful in applications in which the metal tubes and the fittings are swaged remotely from the machine on which they are to be installed.

Figure 1:
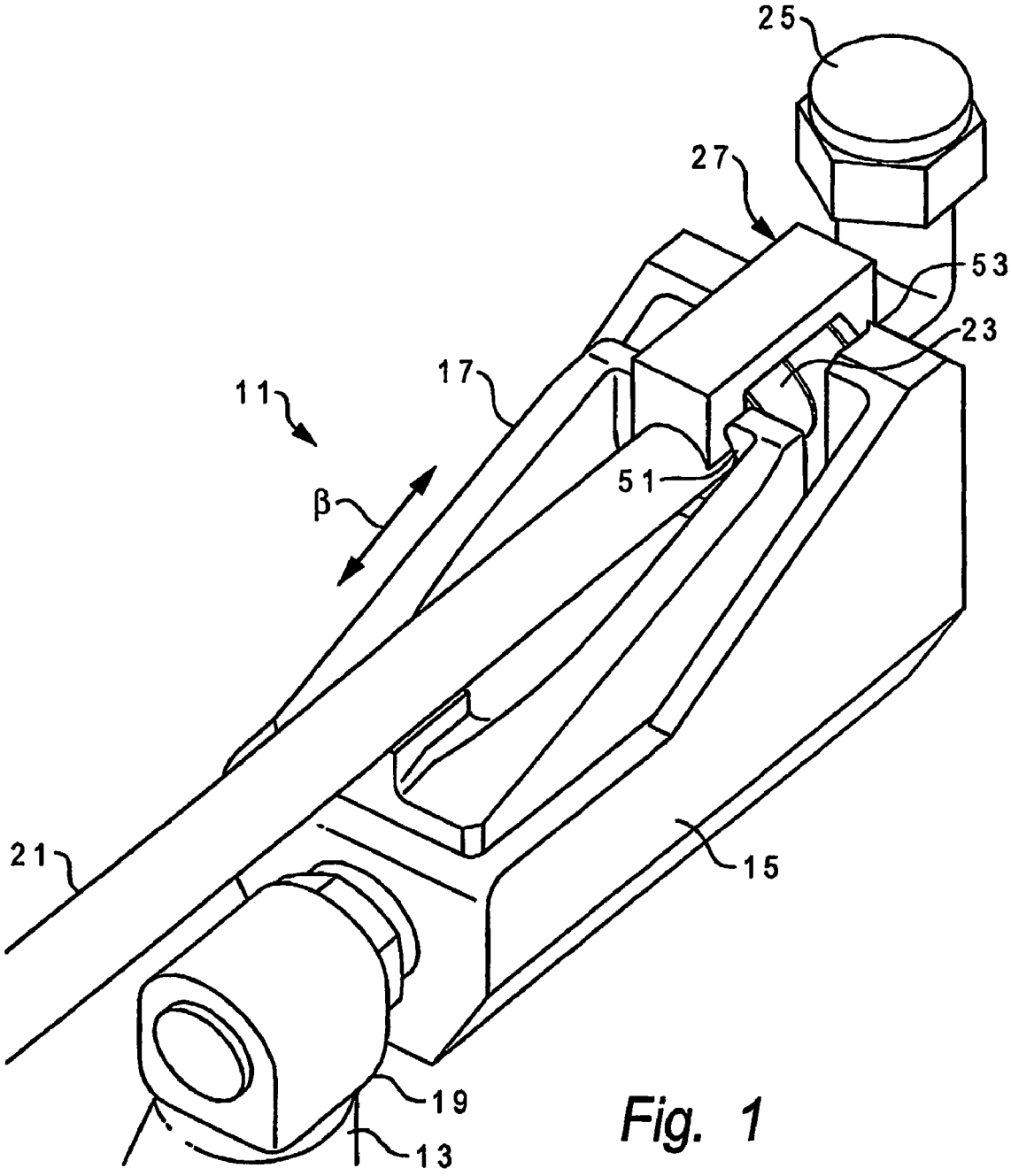
FIG. 1 is a perspective view of the axial swage alignment tool according to the present invention.
Figure 2:
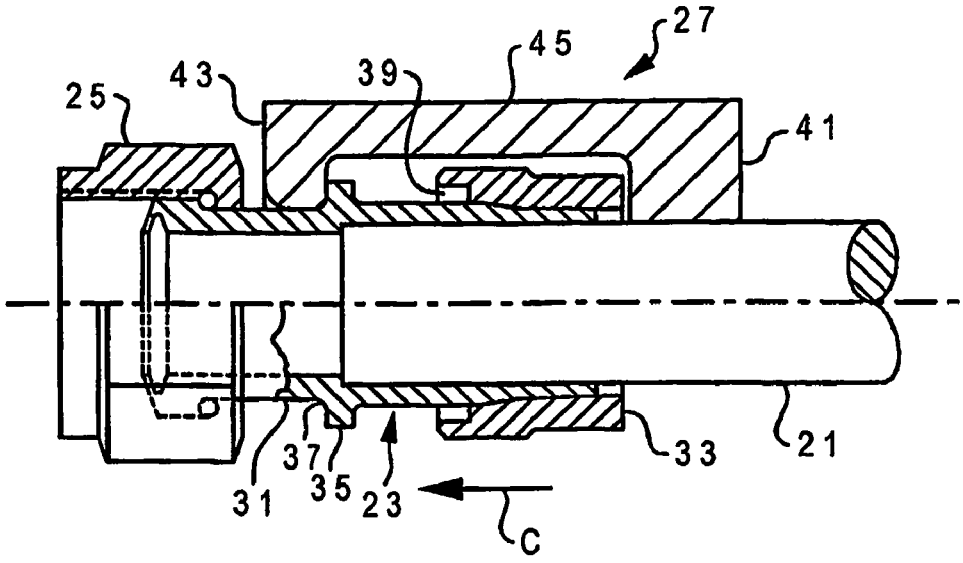
FIG. 2 is a partial longitudinal cross-sectional view of the axial swage alignment tool of FIG. 1.
Figure 3A:
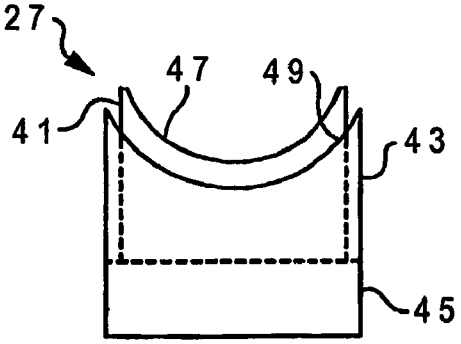
FIG. 3A is a left side view of the bridge member of the axial swage alignment tool of FIG. 1.
Figure 3B:
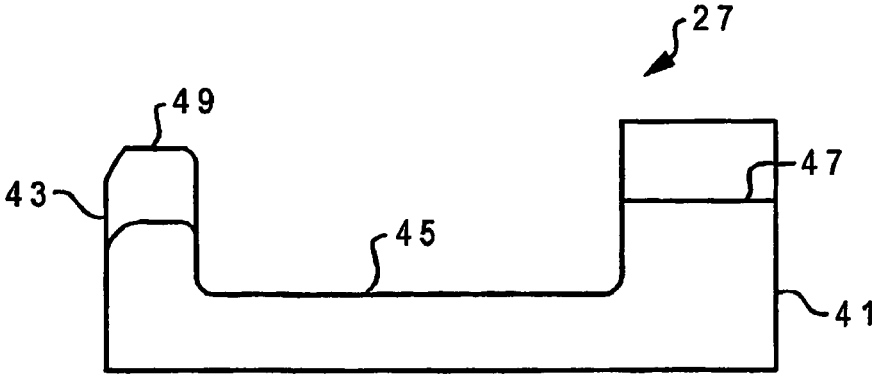
FIG. 3B is a cross-sectional view of the bridge member of FIG. 3A taken at A-A.
Figure 3C:
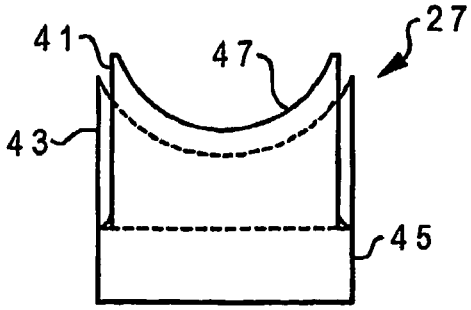
FIG. 3C is a right side view of the bridge member of the axial swage alignment tool of FIG. 1.

Referring to FIG. 1 in the drawings, the preferred embodiment of an axial swage alignment tool 11 according to the present invention is illustrated. Tool 11 is preferably powered by a hydraulic system, but may be powered by other means, such as an electric motor. Tool 11 includes a hydraulic pump (not shown) for pumping high-pressure hydraulic fluid through a hydraulic line 13. Hydraulic line 13 is coupled to a housing 15 and a ram member 17 by a coupling 19. Ram member 17 is driven forward and backward in the direction of arrow B by a piston (not shown) that is in communication with the hydraulic fluid from hydraulic line 13. Tool 11 is used to precisely align and axially swage a metal tube 21 to a fitting 23, so that metal tube 21 can be coupled to an elbow 25 or other tube or component part. A bridge member 27 is used to align tube 21 and fitting 23.

Referring now FIGS. 2 and 3A-3C in the drawings, the assembly of metal tube 21, fitting 23, and elbow 25 is illustrated prior to swaging. As is shown, fitting 23 preferably includes a body portion 31 and a collar 33. Fitting 23 may be any of a wide variety of fittings, including unions, elbows, and tees. Body portion 31 includes a radially outward extending flange 35. One side of flange 35 may form a selected fillet radius 37 with body portion 31. The opposing side of flange 35 is received by a recessed area 39 bored into the end of collar 33 upon swaging.

Bridge member 27 is generally U-shaped having a first end 41, a second end 43, and a cross piece 45. First end 41 includes a contact surface 47 that is curved to match the outside diameter of tube 21. In a similar fashion, second end 43 has a contact surface that is curved to match the outside diameter of fitting 23. In addition, second end 43 includes a fillet radius that matches fillet radius 37 of flange 35. Cross piece 45 is configured to provide sufficient clearance between the inside surface of cross piece 45 and the outside surface of collar 33, including any radially outward deformation that occur to collar 33. Bridge member 27 is preferably made of steel, but may be made of other metallic or strong, rigid materials. Bridge member 27 eliminates the need to place any material between metal tube 21 and fitting 23 either prior to or after the swaging process.

In operation, tube 21 is inserted into fitting 23. Tube 21 may be axially located anywhere within fitting 23. It is not necessary that tubing 21 bottom-out within fitting 23. One significant advantage of the present invention is that tool 11 allows for both axial and rotational alignment of tube 21 and fitting 23. Next, first end 41 of bridge member 27 is adhered to tube 21 and second end 43 of bridge member 27 is adhered to fitting 23. In the preferred embodiment, first end 41 and second end 43 are adhered to metal tube 21 and fitting 23 with cyanoacrylate, or a similar high-strength adhesive for bonding smooth metal parts together. It is preferred that second end 43 butt-up against and be adhered to fillet radius 37 of flange 35. This provides additional strength and stability to the assembly. Once assembled in this fashion, metal tube 21 and fitting 23 may be moved to any convenient location for carrying out the swaging process.

In the swaging process, metal tube 21 is installed into a slot 51 in ram member 17, and fitting 23 is installed into a slot 53 in housing 15 (see FIG. 1). Slot 51 engages collar 33, and slot 53 engages flange 35. Tool 11 is then activated such that ram member 17 forces collar 33 in the direction of arrow C. This movement slightly deforms metal tube 21, body portion 31, and collar 33 and forms a metal-to-metal seal between metal tube 21 and fitting 23. Then, bridge member 27 is pried off of tube 21 and fitting 23. First end 41 and second end 43 of bridge member 27 may then be cleaned with acetone, alcohol, or any other suitable cleansing agent, and reused.

It is apparent that an invention with significant advantages has been described and illustrated. Although the present invention is shown in a limited number of forms, it is not limited to just these forms, but is amenable to various changes and modifications without departing from the spirit thereof.

The invention claimed is:

1. An axial swage alignment tool for swaging together a tube and a fitting having a swaging collar, the axial swage alignment tool comprising:

a housing adapted to engage the fitting;

a ram member adapted to engage the swaging collar, and a bridge member for maintaining the orientation of the tube relative to the fitting during swaging, the bridge member being configured for adhesion to the exterior surfaces of the tube and the fitting.

2. The axial swage alignment tool according to claim 1, wherein the bridge member is U-shaped, having curved contact surfaces for mating with the exterior surfaces of the tube and the fitting.

3. The axial swage alignment tool according to claim 2, wherein the contact surfaces are adapted to be temporarily adhered to the exterior surfaces of the tube and the fitting.

4. The axial swage alignment tool according to claim 1 further comprising:

a means for actuating the ram member.

5. The axial swage alignment tool according to claim 4, wherein the means for actuating the ram member is a hydraulic power source.

6. The axial swage alignment tool according to claim 4, wherein the means for actuating the ram member is an electromechanical power source.

7. A bridge member for use in swaging together a metal tube and a fitting having a swaging flange, the bridge member comprising:

a first end portion having a curved contact surface for matingly contacting the metal tube;

a second end portion having a curved contact surface for matingly contacting the fitting;

a cross piece for connecting the first end portion to the second end portion.

8. The bridge member according to claim 7, wherein the second end portion is configured to mate with the swaging flange.

9. A method of swaging together a metal tube and a fitting having a swaging collar comprising the steps of:

inserting the metal tube into the fitting such that the metal tube is selectively aligned both axially and rotationally with the fitting;

providing a bridge member having a first end and a second end, the first end having a contact surface configured to mate with the exterior surface of the metal tube, the second end having a contact surface configured to mate with the exterior surface of the fitting;

adhering the contact surface of the first end to the metal tube;

adhering the contact surface of the second end to the fitting;

forcing the swaging collar over the fitting;

removing the bridge member from the metal tube and the fitting.

10. The method according to claim 9, wherein the steps of adhering the contact surfaces of the first and second ends to the metal tube and fitting are achieved by using a cyanoacrylate adhesive.

* * * * *